US005740056A

United States Patent [19]

Futamura

[11] Patent Number: 5,740,056

[45] Date of Patent: Apr. 14, 1998

[54] METHOD AND DEVICE FOR PRODUCING EMBROIDERY DATA FOR A HOUSEHOLD SEWING MACHINE

[75] Inventor: Masao Futamura, Nagoya, Japan

[73] Assignee: Brother Kogyo Kabushiki Kaisha, Aichi-Ken, Japan

[21] Appl. No.: 545,436

[22] Filed: Oct. 19, 1995

Related U.S. Application Data

[63] Continuation-in-part of Ser. No. 321,222, Oct. 11, 1994, Pat. No. 5,515,289.

[30] Foreign Application Priority Data

Oct. 19, 1994 [JP] Japan ..... 6-253599

[51] Int. Cl.[6] ..... G06F 15/46

[52] U.S. Cl. ..... 364/470.09; 364/470.08; 364/470.06; 364/470.02; 112/475.19; 112/456

[58] Field of Search ..... 364/470.09, 470.08, 364/470.06, 470.07, 470.02; 112/470.06, 470.04, 475.19, 103, 157, 456

[56] References Cited

U.S. PATENT DOCUMENTS

| | | | |
|---|---|---|---|
| 5,191,536 | 3/1993 | Komuro et al. | 364/470 |
| 5,227,976 | 7/1993 | Hayakawa | 364/470 |
| 5,255,198 | 10/1993 | Yokoe et al. | 364/470 |
| 5,335,182 | 8/1994 | Asano | 364/470 |
| 5,390,126 | 2/1995 | Kongho et al. | 364/470 |
| 5,422,819 | 6/1995 | Nakamura et al. | 364/470 |
| 5,515,289 | 5/1996 | Futamura et al. | 364/470 |
| 5,563,795 | 10/1996 | Futamura et al. | 364/470.09 |
| 5,576,968 | 11/1996 | Mizuno et al. | 364/470.09 |
| 5,592,891 | 1/1997 | Muto | 112/475.19 |

*Primary Examiner*—Emanuel T. Voeltz
*Assistant Examiner*—Hien Vo
*Attorney, Agent, or Firm*—Kane, Dalsimer, Sullivan, Kurucz, Levy, Eisele and Richard, LLP

[57] ABSTRACT

An embroidery data producing device produces embroidery data based on original pattern made up of continuous line components. The embroidery data is supplied to a household sewing machine for embroidering on cloth. A scanner reads an original image and producing pattern image data. Based on the pattern image data, fine-line data is produced, through either sequential fine-line processes or distance conversion processes, for each of the continuous line components. In the processes of extracting fine-line data, data on thickness of each continuous line component is stored in a RAM. An embroidery data is produced based on the data stored in the RAM and the fine-line data, and the embroidery data contains data on stitch width of zig-zag stitch used for the embroidery.

19 Claims, 7 Drawing Sheets

METHOD AND DEVICE FOR PRODUCING EMBROIDERY DATA FOR A HOUSEHOLD SEWING MACHINE

CROSS-REFERENCE TO RELATED APPLICATIONS

This is a continuation-in-part (CIP) of U.S. patent application Ser. No. 08/321,222, now U.S. Pat. No. 5,515,289, filed on Oct. 11, 1994.

BACKGROUND OF THE INVENTION

1. Field of the Invention

The present invention relates to a device for producing embroidery data for use in a sewing machine to form embroidery on a cloth workpiece.

2. Description of the Related Art

There has been known in the field of industrial sewing machines an embroidery data producing device capable of quickly producing highly accurate embroidery data using microcomputers. The device includes an image scanner, a keyboard, a hard disk drive, a CRT display, and other peripheral equipment connected to a general-purpose personal computer. The embroidery data producing device is capable of easily producing embroidery data from an original embroidery design or pattern.

In recent years there has been consumer demand that a relatively inexpensive and easy-to-operate embroidery data producing device be provided for use in conjunction with a household sewing machine. By producing embroidery data with the device, the household sewing machine is capable of embroidering patterns desired by users, not just patterns based on prestored embroidery data. A particularly desirable feature of the embroidery data producing device would be a capability to produce high-quality embroidery data from patterns formed mainly from line drawings, for example, handwritten characters or painted contour pictures.

Conventionally, this type of embroidery data producing device has not had a function for automatically producing embroidery data when the original pattern consists of line drawings. In one conventional method, an operator will use a scanner to read an original pattern and display it on a display. The operator will then trace the displayed image using a mouse. In an alternative conventional method, an operator will manually break down an original line-drawn pattern into a number of line segments, and then digitalize the pattern so it can be inputted into the embroidery data producing device. In such conventional methods, it is a general practice for an experienced operator with good design sense to instruct a desired stitching to each of the line segments from the dissected pattern to produce embroidery data which produces attractive and well-balanced embroidery.

Japanese Laid-Open Patent Publication (A) No. HEI-4-174699 describes another example of an embroidery data producing device having an automatic embroidery data producing capability. The device includes a microcomputer, a small display, a number of operation keys, and a bilevel black and white image scanner connected to the microcomputer. With this device, an operator first reads an original image using the image scanner, then confirms on the display that the read data has the desired form. If so, the embroidery data corresponding to the pattern is produced. The embroidery data producing devices of this kind having an automatic data producing capability produces embroidery data instructing to perform satin stitch or mat-type stitch on an entire region of the pattern.

However, with the first embroidery data producing device, an operator will require a great deal of time, particularly in the case of large and complicated patterns, to rework the shape and to determine the stitching amplitude of each embroidery stitch. Also, these operations are troublesome and require an operator having considerable skill and experience.

The second embroidery data producing device produces embroidery data for filling an entire inner region of the pattern with satin stitches or mat-type stitches. Although satin stitch or mat-type stitch is suitable for embroidering moderately large regions of a pattern, it is not suitable for embroidering lines of pattern, such as of hand-written characters or contour drawings. That is, no automatic embroidery data producing capability is provided in the conventional devices for producing embroidery data for line patterns.

SUMMARY OF THE INVENTION

It is an object of the present invention to overcome the above-described problems and to provide an embroidery data producing device that automatically selects relevant stitches depending on the line thickness of the original pattern through simple procedures that anyone can perform. In accordance with the present invention, embroidery data can be automatically produced which can produce high-quality and attractive embroidery, even for patterns formed mainly from line drawings, such as hand-written characters or contours of colored-in pictures.

To achieve the above and other objects, there is provided an embroidery data producing device for producing embroidery data used in a sewing machine for embroidering on cloth. The device includes image input means for inputting pattern image data representing embroidery patterns. The pattern image data contains pattern components making up the embroidery patterns, and each of the pattern components has a thickness. Fine-line producing means is provided for producing fine-line data based on the pattern image data obtained from the image input means. Characteristic amount calculation means is provided for calculating shape characteristic amount relating to the thickness of pattern components based on the pattern image data obtained from the image input means. Embroidery data producing means produces embroidery data for embroidering the embroidery patterns based on the shape characteristic amount and the fine-line data. The characteristic amount calculation means calculates the shape characteristic amount based on a number of times that sequential fine-line processes are performed. Alternatively, the characteristic amount calculation means performs distance conversion processes on the pattern components. The embroidery data producing means sets stitch width of staggered stitch based on the shape characteristic amount.

In operation, the image input means inputs a pattern image data representing an embroidery pattern into the embroidery data producing device so that the embroidery data producing device can process the pattern. Based on the pattern image data obtained from the image input means, a fine-line producing means picks up fine-line component data by processing individual components of the pattern, thereby enabling the device to process patterns as lines. Based on the pattern image data obtained from the image input means, the characteristic amount calculation means calculates form characteristic amounts, which depend on the thickness of lines making up the patterns. Finally, an embroidery data producing means produces embroidery data for embroidering a pattern based on the form characteristic amount and the fine-line data. The resultant embroidery data therefore reflects the characteristics of the pattern.

In accordance with another aspect of the invention, there is provided an embroidery data producing device for producing embroidery data that includes a scanner reading an original image and producing pattern image data. The original image contains continuous line components, and each of the continuous line components has a thickness. Fine-line producing means is provided for producing, based on the pattern image data obtained from the scanner, fine-line data through sequential fine-line processes for each of the continuous line components. Storage means stores data on a number of times that the sequential fine-line processes are performed for each of the continuous line components by the fine-line producing means. Embroidery data producing means produces embroidery data based on the data stored in the storage means and the fine-line data.

In accordance with still another aspect of the invention, fine-line producing means produces, based on the pattern image data obtained from the scanner, fine-line data through distance conversion processes for each of the continuous line components. The distance conversion processes are performed to evaluate a distance value measured from a predetermined position to each of dots making up of the continuous line component.

Continuous line component extracting means may further be provided for extracting the continuous line components contained in the original image. Segmenting means may also be provided for dividing each of the continuous line components into a predetermined number of line segments. Preferably, the embroidery data producing means includes stitch type determining means for determining a stitch type for each of the predetermined number of line segments based on the data stored in the storage means. The stitch type determining means determines stitch width of staggered stitch based on the data stored in the storage means.

In accordance with further aspect of the invention, there is provided a method of producing embroidery data, which includes the steps of (a) inputting pattern image data representative of an original image which contains continuous line components, each of the continuous line components having a thickness, (b) producing, based on the pattern image data, fine-line data for each of the continuous line components, (c) storing thickness data on each of the continuous line components, and (d) producing embroidery data based on the thickness data and the fine-line data.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 4:
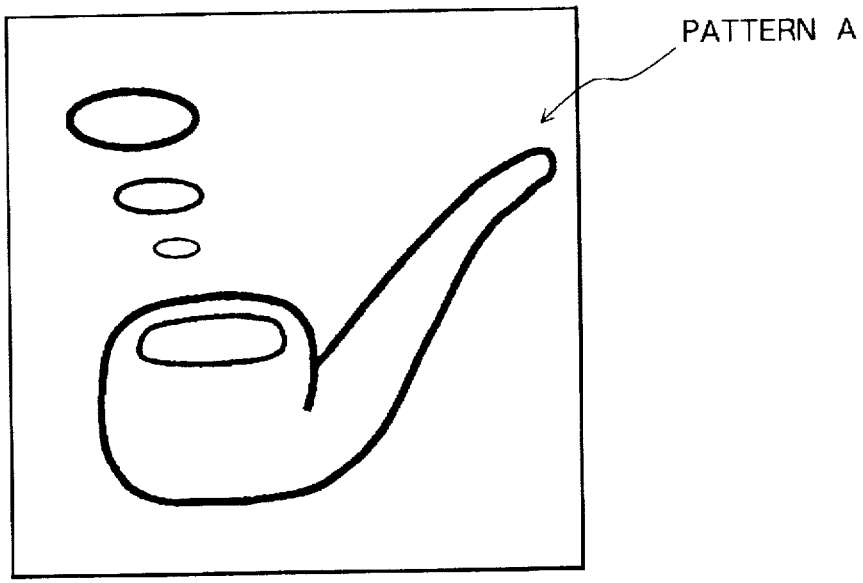
FIG. 4 is an example of an original pattern for use in embroidering with the device of the present invention.

An embroidery data producing device for household use according to a preferred embodiment of the present invention will be described while referring to the accompanying drawings. A line drawing of a pipe and smoke as shown in FIG. 4 will be used as an original pattern in producing embroidery data with the embroidery data producing device according to the embodiment of the invention.

First, a brief description will be provided for a household embroidery sewing machine which is capable of embroidery. An embroidery frame supporting a cloth workpiece is positioned on the bed of the sewing machine. To embroider a predetermined pattern onto the cloth workpiece, a horizontal movement mechanism moves the embroidery frame to predetermined positions indicated by X-Y coordinate values of the sewing machine while a sewing needle mechanism and a shuttle mechanism stitch thread onto the cloth workpiece.

The sewing needle and horizontal movement mechanisms are controlled by a control device, such as a microcomputer. The control device is inputted with embroidery data or stitch data that indicates needle location relative to the embroidery frame, that is, the amount the frame is to be moved in the X and Y directions for each stitch. The embroidery sewing machine is thus capable of automatically embroidering patterns in accordance with the embroidery data. The embroidery sewing machine of this embodiment is provided with a flash memory. As will be described in more detail later, a card type flash memory is used for providing embroidery data from an external source, that is, the embroidery data producing device, to the embroidery sewing machine.

Figure 2:
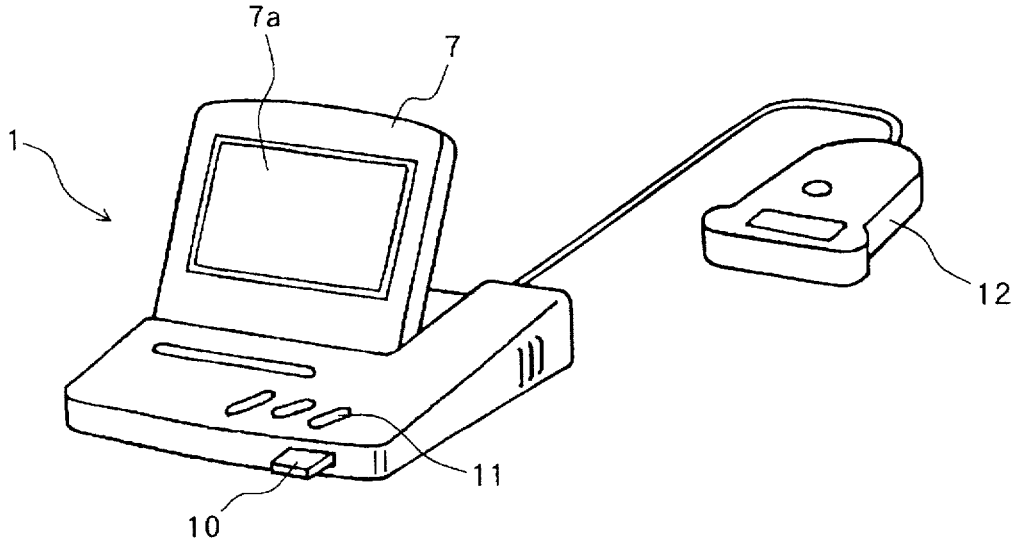
FIG. 2 is a perspective view showing the embroidery data producing device according to the present invention.
Figure 3:
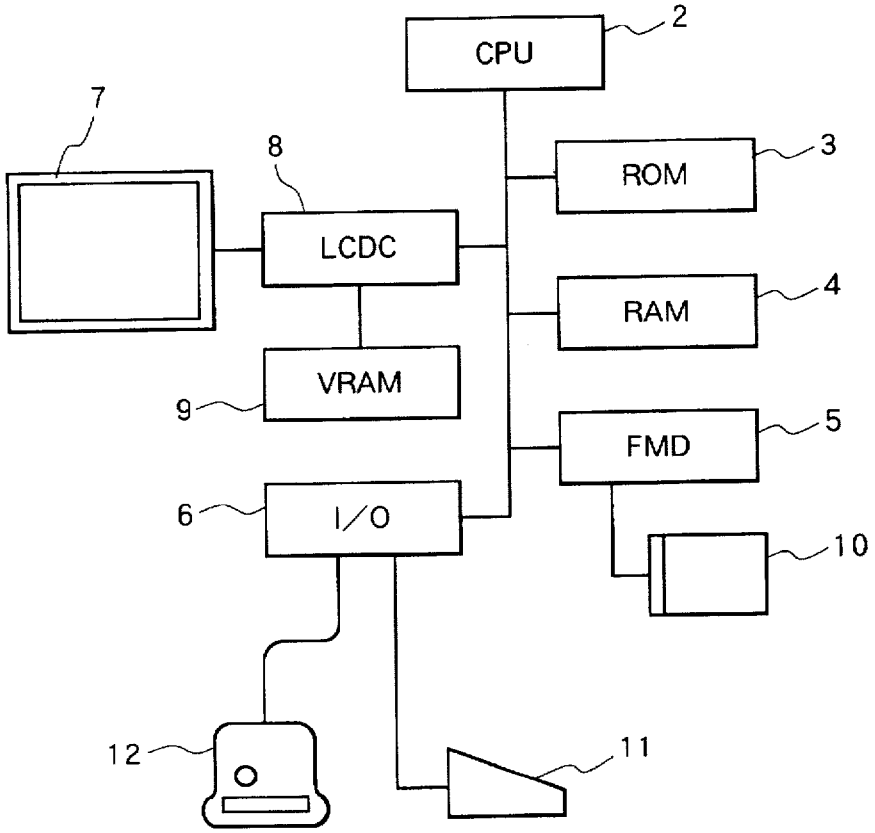
FIG. 3 is a block diagram showing electrical configuration of major components of the embroidery data producing device according to the present invention.

The overall configuration of the embroidery data producing device of the present embodiment will be described while referring to FIGS. 2 and 3. FIG. 2 is a perspective view showing the embroidery data producing device of the present embodiment. FIG. 3 is a block diagram showing electrical configuration of major components of the embroidery data producing device. As shown in FIG. 3, the producing device 1 includes a CPU 2, a ROM 3, RAM 4, a flash memory device (FMD) 5, and a input/output interface 6, all connected to each other by a bus.

A liquid crystal display (LCD) 7 is provided on the upper portion of the producing device 1. The LCD 7 is for displaying retrieved patterns and the like on a screen 7*a* to allow confirmation of the patterns. The LCD 7 is controlled by a liquid crystal display controller (LCDC) 8. A display memory device (VRAM) 9 is connected to the LCDC 8. Also, a flash memory 10 serving as a memory medium is detachably mounted to the flash memory device 5. An operation panel 11, by which an operator enters various commands, and an image scanner 12 for reading original patterns are connected to the CPU 2 via the input/output interface 6.

A hand-held scanner is used as the image scanner 12, which reads a monochrome original pattern and outputs binary bit map image data representative of the pattern. To read an original pattern, an operator grips the upper portion of the hand-held scanner 12 and places the lower surface of the hand-held scanner 12 against the original pattern. The operator then presses the read button and moves the hand-held scanner 12 in one direction over the document. The read pattern image data is stored in the RAM 4 as a bit map data for raster scan, wherein each picture element (pixel) is represented by one bit of data having a value of 0 or 1 for white and black dots respectively.

Software drives the producing device 1 to automatically produce embroidery data based on, for example, the original "pipe and smoke" pattern shown in FIG. 4. The software is stored in the ROM 3 for controlling the CPU 2. The operation of the software will be explained while referring to the flowchart shown in FIG. 1.

In order to produce embroidery data, in step 1 an operator reads the original pattern A using the hand-held scanner 12 after starting up the program of the producing device 1. The binary bit map image data of the pattern A is outputted from the hand-held scanner 12 and is stored in a predetermined region of the RAM 4.

Figure 5:
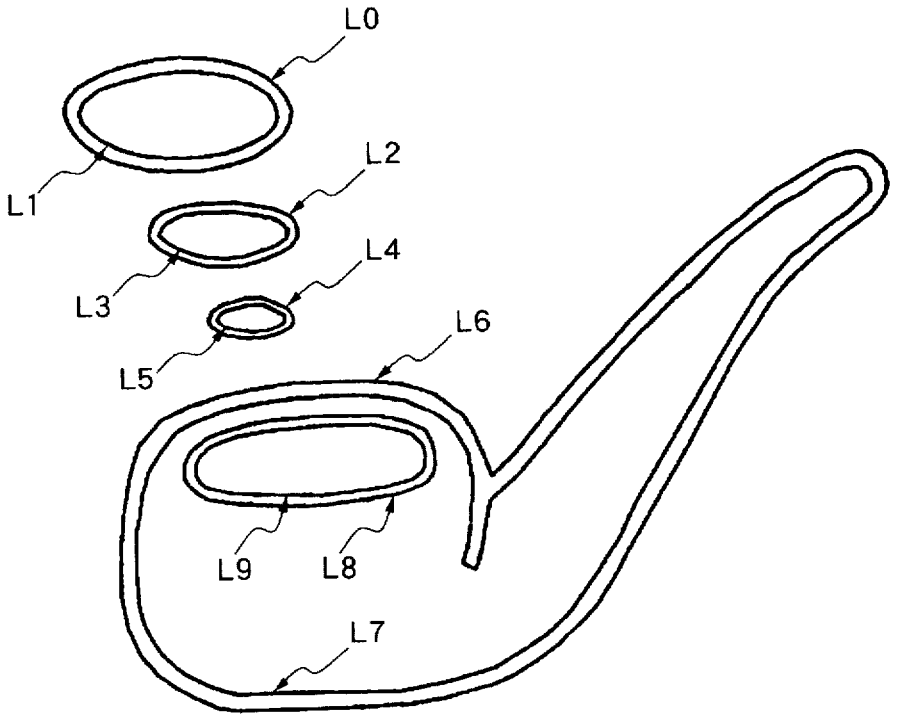
FIG. 5 is a diagram showing borderlines of the original pattern.

In step 2, borderline extraction processes are executed on the image data of pattern A stored in the RAM 4 to pick up continuous line components in the pattern A. The continuous line components are the building blocks of an overall pattern and are formed from trains of connected black pixels. Well-known borderline extracting algorithms can be applied to borderline extraction processes. In this algorithms, whether or not pixels are to be connected can be judged on a basis of either four- or eight-pixel units. These algorithms are not essential elements of the present invention, so their detailed description will be omitted here. In the borderline extraction processes, the borderlines L0 through L9 are automatically extracted as shown in FIG. 5. Although the borderlines shown in FIG. 5 are drawn by continuous solid lines, each line is actually formed from a series of black dots.

In regards to the making up the "smoke ring" connected-pixel components, the borderlines L0, L2, and L4 define the outer periphery of the large, medium, and small smoke rings respectively. Similarly, the borderlines L1, L3, and L5 define the inner diameters, or the holes, of the large, medium, and small smoke rings respectively. Using the "pipe" connected-pixel components as an example, the borderlines L6 and L7 define the outer and inner borders respectively of the pipe body and the borderlines L8 and L9 define the outer and inner borders respectively of the pipe hole.

In step 3, the borderlines of the connected-pixel components extracted in step 2 are processed into fine lines. The fine lines are produced by selectively deleting the pixels aligned in the direction of thickness of the extracted line, starting from the outermost pixels and according to a predetermined rule. Such a pixel deleting procedure is continued until no pixels to be deleted according to the predetermined rule remain unprocessed.

A variety of rules relating to the standard for determining whether or not a pixel will be deleted have been proposed for obtaining good-quality fine-line components. Basically, any well-known sequential fine line producing method that obtains components with line width of one pixel can be adopted to the process in S3. The number of times pixel-deletion processes are performed in step 3 are calculated for each connected-pixel component simultaneously with execution of the sequential fine-line processes. The number of pixel-deletion processes performed for each connected-pixel component is stored in a predetermined region of the RAM 4 as a value N.

Figure 6:
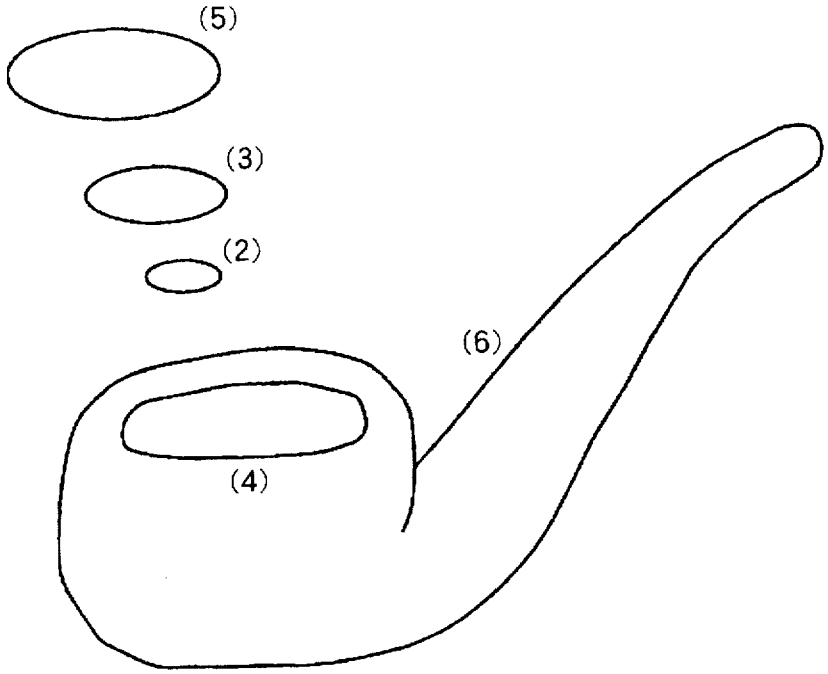
FIG. 6 is a diagram showing a fine-line image data produced from the pattern shown in FIG. 4.

The sequential deletion processes described above are performed on the pixels between inner and outer borderlines of all connected-pixel components, until all the connected-pixel components making up the pattern A are fine-line processed and the number of pixel-deletion processes N are stored for each connected-pixel component. FIG. 6 represents the resultant fine-line image of pattern A. As described above, the fine lines shown in FIG. 6 are actually formed from a closed chain of connected pixels, although they are drawn by single connected lines to make the drawing clearer. The numeric values in parenthesis in FIG. 6 represent the number of pixel-deletion processes N calculated as described for fine-line processes for each fine-line connected-pixel component.

Figure 7:
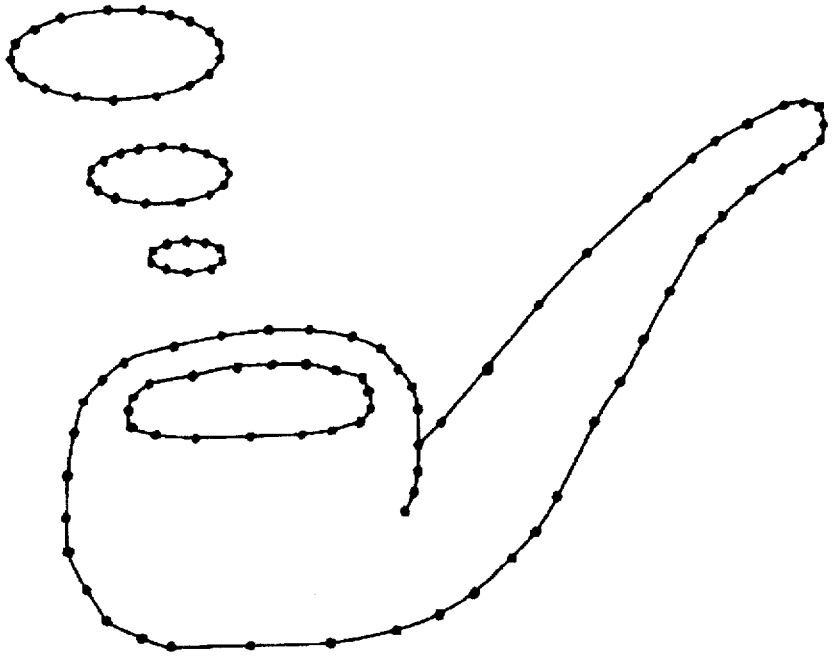
FIG. 7 is a diagram showing vectors constituting the fine-line image.

In the vector processes of step 4, the fine-line image data formed for each connected-pixel component of pattern A during the fine-line processes of step 3 is converted to short vectors, that is, to data of line segments, each with an appropriate length and direction, which collectively form the connected-pixel components. In the simplest vector processing method, an optional pixel of the fine-line image data, for example, the pixel at the top left position of a component, is set as the starting point. A group of form characteristic points for each fine-line component is obtained by tracing the pixel chains forming the fine-line components while sampling, at an appropriate interval, coordinates of each pixel forming the chains. Alternatively, a characteristic point on the fine line can be determined while evaluating a difference between a vector defined by that characteristic point and a reference vector. Although a concrete example of procedure related to processes for vectoring component data will not be provided in this specification, an example of characteristic points, or short vector data, obtained for a connected-pixel component of pattern A using the above-described manner is shown in FIG. 7. In FIG. 7, black dots represent characteristic points, that is, points where ends of two or more short vectors connect to each other.

Based on short vector data, the particular kind of stitch, or stitch type, to which the embroidery data will be set is determined in step 5 basically following the procedures described below. The number of pixel-deletion processes N calculated and stored in the RAM 4 in step 3 are referred to for each connected-pixel component forming pattern A. Stitch type is set during conversion of each component to embroidery data based on the size of the fine-line repetition number N. For example, the stitch type is set to:

triple stitch when $1 \leqq N < 3$;

1.2 mm width zig-zag stitching when $3 \leqq N < 5$; and 1.8 mm width zig-zag stitching when $5 \leqq N$.

When only a small number of pixel-deletion processes N were performed, this indicates that the original line corresponding to the value N had a narrow width. Therefore, the corresponding embroidery data is also set to a stitch type that will result in embroidery lines with narrow widths. Similarly, when a large number of pixel-deletion processes N were performed, this indicates that the original line corresponding to the value N had a thick width. Therefore, the corresponding embroidery data is also set to a stitch type that will result in embroidery lines with thick widths. By setting the stitch type for each component, embroidery data can be prepared that, to a certain degree, reflects information on line thickness that was lost for the original component during fine-line processes. In the example of the "pipe and smoke" pattern A, the stitch type is set to a width of 1.8 mm for the largest smoke ring and the pipe body, to 1.2 mm for the mid-sized smoke ring and the pipe hole, and to triple stitch for the smallest smoke ring.

Next, in step 6, the short vector data of each component prepared in step 4 is converted to embroidery data according to the stitch type determined in step 5. Embroidery data is produced according to the stitch type. For example, if a component is to embroidered using zig-zag stitch, needle locations are set to staggered positions at both side of each short vector. Each needle location is apart or offset from the short vector's line by a predetermined distance, i.e., one half a width set for zig-zag stitching. On the other hand, if triple stitches are to be performed, needle locations are sequentially set to positions corresponding to short vector length along the direction of the subject vector.

Figure 1:
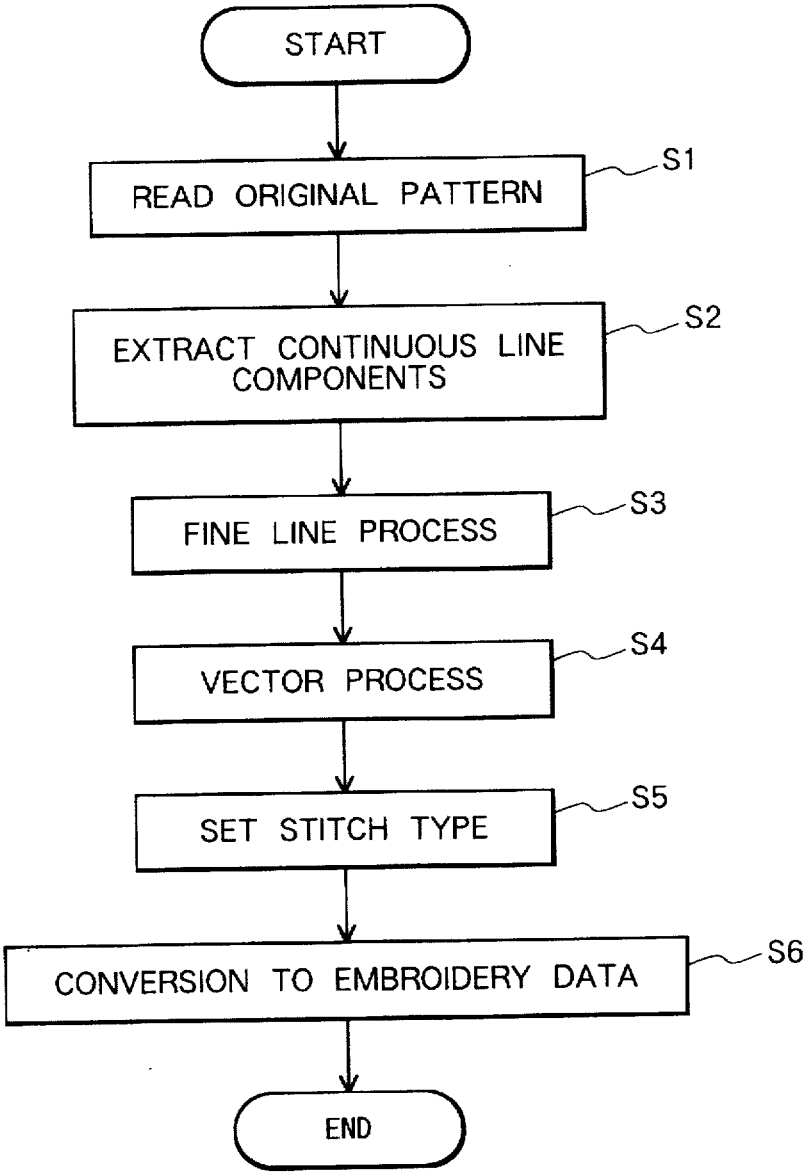
FIG. 1 is a flowchart illustrating operations performed by an embroidery data producing device according to a first embodiment of the present invention.
Figure 8:
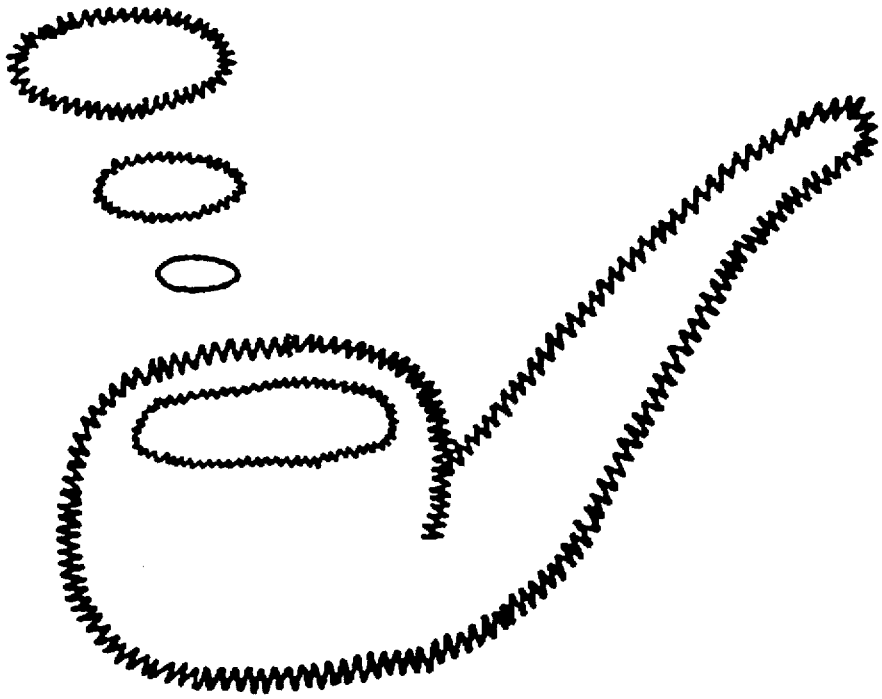
FIG. 8 is a stitched embroidery produced by the device of the present invention.

Although not shown in the flowchart of FIG. 1, the embroidery data thus produced is stored in the flash memory 10 via the flash memory device 5. As shown in FIG. 8, a design corresponding to pattern A can be embroidered by loading the flash memory 10 into an embroidery machine.

Next, an automatic embroidery data producing device for household use according to a second embodiment of the present invention will be described. Unlike the device of the first embodiment wherein the number of pixel-deletion processes is counted, the device of the second embodiment uses a distance value obtained as a result of distance conversion processes performed with respect to each of the connected-pixel components. The overall configuration of the producing device and also the operation example are the same as those described in the first embodiment.

Figure 9:
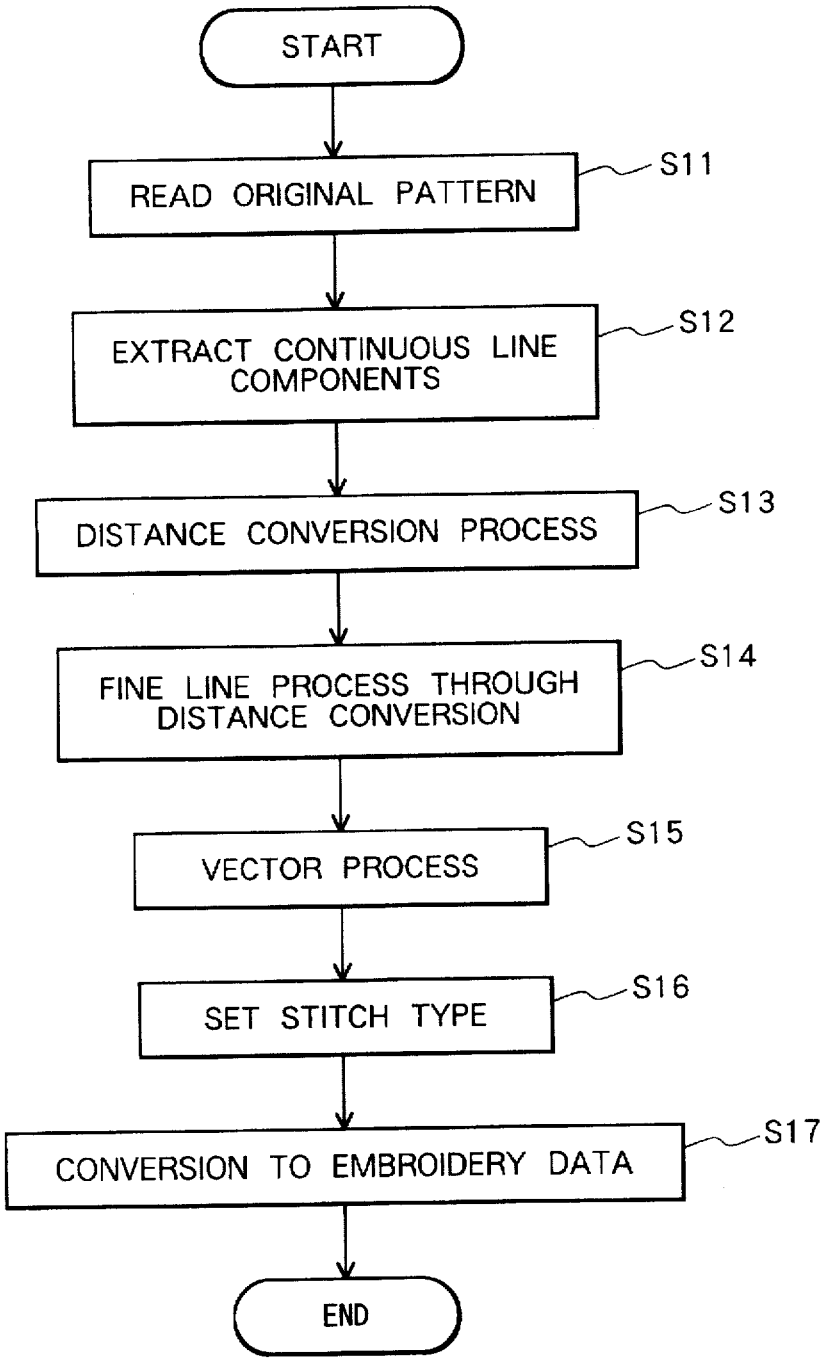
FIG. 9 is a flowchart illustrating operations performed by an embroidery data producing device according to a second embodiment of the present invention.

The operation of the second embodiment will be described while referring to the flowchart in FIG. 9. Processes of step 14 in FIG. 9 are similar to the fine-line processes of step 3, differing in that the number of pixel-deletion processes performed during fine-line processes is not stored in step 14.

After the borderline extraction processes of step 12 are performed on each connected-pixel component, distance conversion processes are executed for each connected-pixel component in S13. In the distance convention processes, a value is determined that indicates the distance between an optional pixel of a component and the nearest borderline pixel of the same component. Pixels positioned at the edge, or borderline, of each component are provided with a distance value of 1. The further away pixels are from the borderline, the larger their distance values will be. The distance value is determined for each pixel of each connected-pixel component, that is, for pixels surrounded by the border line and included in the borderline itself.

Figure 10:
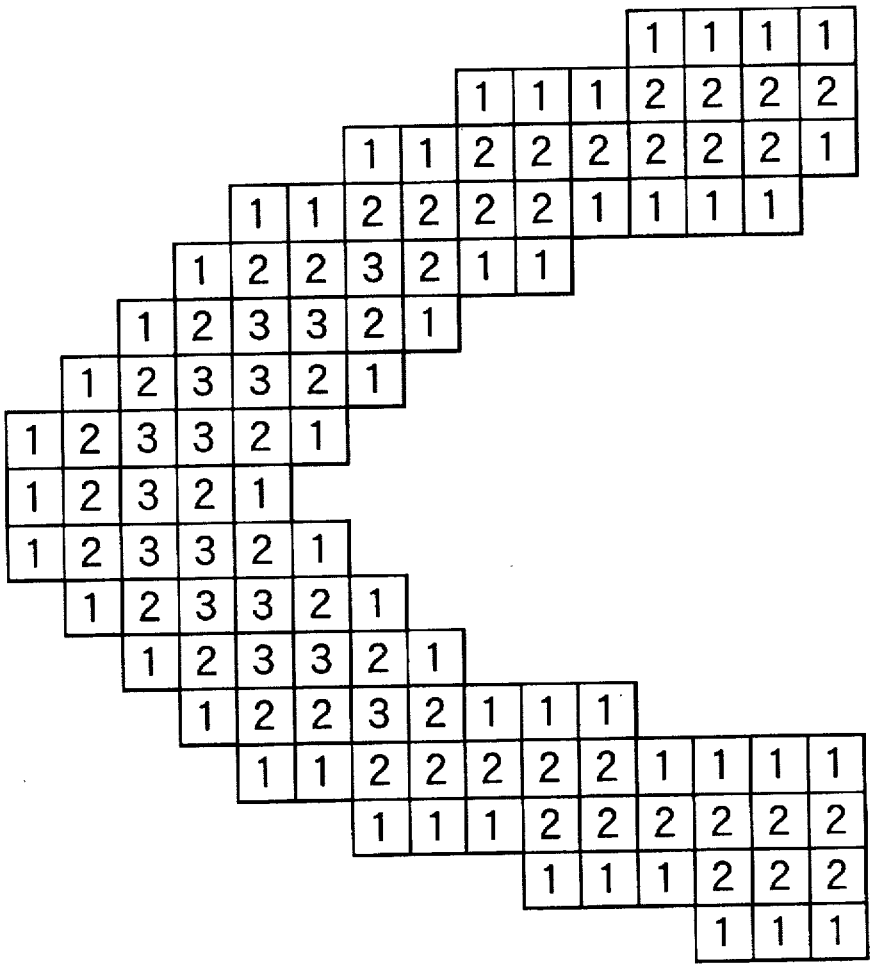
FIG. 10 is a diagram indicating distance converted values for a part of a continuous line component.

Well-known algorithms available for performing distance conversion in image processings can be applied to perform this task. Because distance conversion algorithms themselves are not a basic part of the present invention, their detailed explanation will be omitted here. To facilitate understanding, a portion of the distance conversion results for one of the smoke ring components of pattern A is shown in FIG. 10.

Because the distance values are obtained for each of the pixels forming the component, a number of distance values that equal the number of pixels will be obtained. The largest distance values are extracted from all the distance values of each component and stored at a predetermined region of the RAM 4. The largest distance values stored for each component in the RAM 4 serve as characteristic amounts and fill the same role as the number of pixel-deletion processes value N described in the first embodiment.

In step 14 and on, fine-line data for the pattern components is prepared using the same operations as described in the flowchart in FIG. 1. In step 16, however, the maximum distance value obtained in step 13 is referred to instead of the number of pixel-deletion processes N. Instead of referring to the maximum distance value, the ratio of pixels having a distance equal to or greater than a predetermined value or the average of all large distance value may be referred to in determining stitching type.

The processes performed in steps 5 and 16 of the above-described embodiments result in stitches that conform to characteristics of the line segments making up the original line drawing so that attractive and high-quality embroidery data can be automatically prepared without the need to perform such troublesome operations as serially tracing lines of each component to input characteristics or indicating the stitch width and stitch type to be applied for each component. Because embroidery data is automatically prepared, operations are simple, allowing anyone, even persons with no training or skill, to prepare the embroidery data.

As described above, fine-line processes convert original patterns into lines without taking variations in the thickness of the original handwritten lines into consideration. For example, all portions of a hand-drawn line are processed to a minimum unit of thickness set for the fine-line processes. Therefore, resultant lines will all have the same thickness even if certain portions of the original hand-drawn line are thicker or narrower than others. The sense of thicker or thinner portions in the original pattern will be lost if embroidery data is prepared based only on the fine lines. This will result in mundane embroidery. However, according to the present invention, stitch types such as zig-zag stitch can be automatically set according to variations in thickness of retrieved lines. Therefore, embroidery can be formed with richer variation.

While the invention has been described in detail with reference to specific embodiments thereof, it would be apparent to those skilled in the art that various changes and modifications may be made therein without departing from the spirit of the invention, the scope of which is defined by the attached claims.

For example, although borderline extraction processes were adopted in steps 2 and 12 to pick up continuous line components from an original pattern, well-known region-labelling processes can be applied instead. Stitches with widths other than 1.8 mm or 1.2 mm can be set in steps 5 and 16 above for zig-zag stitches. Also, three or more stitch widths can be selected against a plurality of thresholds set as standards, or the stitch type can be simply switched between a zig-zag stitch and a straight stitch with a suitable width. In the embodiments, the stitch type and the stitch width were set to correspond to a preset value or stitch type. However, the device can be designed so that these values can be manually set by an operator. Also the stitch type can be a special stitch design pattern. The processes for conversion to embroidery data performed in steps 6 and 17 can be performed so as to produce block-format embroidery data.

Also, in the above-described embodiments, the embroidery data producing device included a hand scanner 12. However, a desk-top scanner can be provided for reading pattern image data instead of the hand-held scanner 12. Without using scanners, pattern data can be provided from an external memory device such as an FD or a flash card. Alternatively, data representing a pattern can be inputted to the embroidery data producing device from computer assisted design (CAD) equipment. Also, a personal computer can be adopted as the hardware for the embroidery data producing device. Although in the above-described embodiments, the central line of zig-zag stitch is aligned on the obtained vectors, the return positions to one side of zig-zag stitches could be aligned to the obtained vectors.

An embroidery data producing device according to the present invention can prepare embroidery data from an original pattern formed mainly from line drawings, such as penciled characters or painted pictures, using simple operations that do not require manually breaking down the original into a plurality of line segments, inputting the line segments, and designating the stitch type or stitch width for each line segment. The embroidery data automatically prepared by the embroidery data producing device allows embroidering of attractive and high-quality embroidery patterns, with variation in stitches.

In summary, an embroidery data producing device according to the present invention can automatically produce data for producing attractive and high-quality embroidery, that accurately reflects variation in thickness of the original pattern.

What is claimed is:

1. An embroidery data producing device for producing embroidery data used in a sewing machine for embroidering on cloth, the device comprising:

image input means for inputting pattern image data representing embroidery patterns, the pattern image data containing pattern components making up the embroidery patterns, each of the pattern components having a thickness;

fine-line producing means for producing fine-line data based on the pattern image data obtained from said image input means, wherein said fine-line data represents fine-line images of each of the pattern components, each of the fine-line images having a predetermined thickness;

characteristic amount calculation means for calculating shape characteristic amount relating to the thickness of pattern components based on the pattern image data obtained from said image input means; and embroidery data producing means for producing embroidery data for embroidering the embroidery patterns based on the shape characteristic amount and the fine-line data.

2. An embroidery data producing device as claimed in claim 1, wherein said characteristic amount calculation means calculates the shape characteristic amount based on a number of times that sequential fine-line processes are performed.

3. An embroidery data producing device as claimed in claim 1, wherein said characteristic amount calculation means performs distance conversion processes on the pattern components.

4. An embroidery data producing device as claimed in claim 1, wherein said embroidery data producing means sets stitch width of zig-zag stitch based on the shape characteristic amount.

5. An embroidery data producing device for producing embroidery data, the device comprising:

a scanner reading an original image and producing pattern image data, the original image containing continuous line components, each of the continuous line components having a thickness;

fine-line producing means for producing, based on the pattern image data obtained from said scanner, fine-line data through sequential fine-line processes for each of the continuous line components;

storage means for storing data on a number of times that the sequential fine-line processes are performed for each of the continuous line components by said fine-line producing means; and embroidery data producing means for producing embroidery data based on the data stored in said storage means and the fine-line data.

6. An embroidery data producing device as claimed in claim 5, further comprising continuous line component extracting means for extracting the continuous line components contained in the original image.

7. An embroidery data producing device as claimed in claim 6, further comprising segmenting means for dividing each of the continuous line components into line segments.

8. An embroidery data producing device as claimed in claim 7, wherein said embroidery data producing means includes stitch type determining means for determining a stitch type for each of the continuous line components based on the data stored in said storage means.

9. An embroidery data producing device as claimed in claim 8, wherein said stitch type determining means determines stitch width of zig-zag stitch based on the data stored in said storage means.

10. An embroidery data producing device for producing embroidery data, the device comprising:

a scanner reading an original image and producing pattern image data, the original image containing continuous line components, each of the continuous line components having a thickness and composed of a series of dots;

fine-line producing means for producing, based on the pattern image data obtained from said scanner, fine-line data through distance conversion processes for each of the continuous line components, wherein the distance conversion processes are performed to evaluate a distance value measured from a predetermined position to each of dots making up of the continuous line component;

storage means for storing data on the distance value with respect to each of the continuous line components; and embroidery data producing means for producing embroidery data based on the data stored in said storage means and the fine-line data.

11. An embroidery data producing device as claimed in claim 10, further comprising continuous line component extracting means for extracting the continuous line components contained in the original image.

12. An embroidery data producing device as claimed in claim 11, further comprising segmenting means for dividing each of the continuous line components into line segments.

13. An embroidery data producing device as claimed in claim 12, wherein said embroidery data producing means includes stitch type determining means for determining a stitch type for each of the continuous line components based on the data stored in said storage means.

14. An embroidery data producing device as claimed in claim 13, wherein said stitch type determining means determines stitch width of zig-zag stitch based on the data stored in said storage means.

15. A method of producing embroidery data, comprising the steps of:

inputting pattern image data representative of an original image which contains continuous line components, each of the continuous line components having a thickness;

producing, based on the pattern image data, fine-line data for each of the continuous line components;

storing thickness data on each of the continuous line components; and producing embroidery data based on the thickness data and the fine-line data.

16. A method as claimed in claim 15, further comprising the step of extracting the continuous line components contained in the original image.

17. A method as claimed in claim 16, further comprising the step of dividing each of the continuous line components into line segments.

18. A method as claimed in claim 17, further comprising the step of determining a stitch type for each of the continuous line components based on the thickness data.

19. A method as claimed in claim 18, wherein stitch width of zig-zag stitch is determined based on the thickness data.

* * * * *